US011858684B2

(12) United States Patent
Hammond et al.

(10) Patent No.: US 11,858,684 B2
(45) Date of Patent: Jan. 2, 2024

(54) DISPENSING SYSTEM

(71) Applicant: AptarGroup, Inc., Crystal Lake, IL (US)

(72) Inventors: James Hammond, North Prairie, WI (US); Timothy Mazurkiewicz, Oconomowoc, WI (US); Anna Frolova-Levi, Mukwonago, WI (US)

(73) Assignee: AptarGroup, Inc., Crystal Lake, IL (US)

( * ) Notice: Subject to any disclaimer, the term of this patent is extended or adjusted under 35 U.S.C. 154(b) by 757 days.

(21) Appl. No.: 16/982,151

(22) PCT Filed: Mar. 21, 2019

(86) PCT No.: PCT/US2019/023287

§ 371 (c)(1),
(2) Date: Sep. 18, 2020

(87) PCT Pub. No.: WO2019/183301

PCT Pub. Date: Sep. 26, 2019

(65) Prior Publication Data

US 2021/0024249 A1 Jan. 28, 2021

Related U.S. Application Data

(60) Provisional application No. 62/646,137, filed on Mar. 21, 2018.

(51) Int. Cl.
*B65D 17/44* (2006.01)
*B65D 81/32* (2006.01)

(52) U.S. Cl.
CPC ..... *B65D 17/44* (2018.01); *B65D 81/3211* (2013.01)

(58) Field of Classification Search
CPC ..... B65D 17/44; B65D 17/42; B65D 81/3211
(Continued)

(56) References Cited

U.S. PATENT DOCUMENTS

D189,164 S * 11/1960 Hollister et al. ..... D9/447
D213,428 S * 3/1969 Batdorf ..... D9/429
(Continued)

FOREIGN PATENT DOCUMENTS

| | | | |
|---|---|---|---|
| CN | 206045521 | U | 3/2017 |
| EP | 1655239 | B1 | 6/2009 |
| WO | 2005012133 | A1 | 2/2005 |

OTHER PUBLICATIONS

International Search Report and Written Opinion dated May 30, 2019.

*Primary Examiner* — Lien M Ngo
(74) *Attorney, Agent, or Firm* — Wood, Phillips, Katz, Clark & Mortimer

(57) ABSTRACT

A dispensing system (40, 40A) includes a body (54, 54A) having an outer wall (56, 56A) defining a volume for storing a substance, the outer wall (64, 64A) having a top end (66, 66A) and a sealed bottom end (70, 70A). The top end (66, 66A) is covered by a flexible lid (56, 56A) that is connected to the body (54, 54A). The lid (56, 56A) has a press portion (88, 88A) for being engaged to move the lid (56, 56A) from a first position into a second, deflected position. A post (58, 58A) is connected to the lid (56, 56A) and is configured in the second position of the lid (56, 56A) to breach the sealed bottom end (70, 70A) to form a dispensing orifice (80, 80A) to accommodate movement of a substance out of the body (54, 54A).

14 Claims, 20 Drawing Sheets

(58) Field of Classification Search
USPC ..... 222/83, 80; 206/219–222; 220/669, 267, 220/277, 278
See application file for complete search history.

(56) References Cited

U.S. PATENT DOCUMENTS

| | | | | | |
|---|---|---|---|---|---|
| 4,634,003 | A * | 1/1987 | Ueda | B65D 81/3222 | 426/120 |
| D411,288 | S * | 6/1999 | Cuttriss | D23/284 | |
| 6,305,576 | B1 * | 10/2001 | Leoncavallo | B65D 51/2814 | 222/88 |
| 8,839,982 | B1 * | 9/2014 | Anderson | B65D 51/2835 | 220/267 |
| 2002/0157971 | A1 * | 10/2002 | Carlson | B65D 51/2814 | 206/222 |
| 2003/0041853 | A1 | 3/2003 | Kolb | | |
| 2004/0026422 | A1 * | 2/2004 | Westphal | B65D 51/226 | 220/277 |
| 2007/0007311 | A1 | 1/2007 | Uytterhaeghe et al. | | |
| 2009/0242561 | A1 * | 10/2009 | Wellman | B65D 51/2857 | 215/364 |
| 2010/0200437 | A1 * | 8/2010 | Coon | B65D 81/3222 | 215/DIG. 1 |
| 2011/0174642 | A1 * | 7/2011 | Coon | B65D 51/2835 | 215/228 |
| 2015/0175337 | A1 | 6/2015 | Lee | | |

* cited by examiner

DISPENSING SYSTEM

TECHNICAL FIELD

The present invention relates generally to a dispensing system for dispensing a substance into a container of another substance or onto some other target region.

BACKGROUND OF THE INVENTION AND TECHNICAL PROBLEMS POSED BY THE PRIOR ART

Many types of containers of substances are provided to a user initially in a closed condition that requires the user to remove or open a closure to gain access to the contents of the container. Such a container may be a bottle, flexible pouch, machine, vessel, etc., having an interior accessible through an opening in the container. A typical closure may be a cap, cover, or lid arranged at an opening to the container interior and is cooperatively received by a receiving structure on the container. Such a receiving structure may include mating threads, snap-fit beads or grooves, toggle clamps, friction fittings, or other such features.

Various materials or substances may be stored in the system, such as medicaments, additives, oils, lotions, creams, gels, liquids, food items, granules, powders, etc. The container with the closure mounted thereon, and the contents stored therein, may be characterized as a "package."

Some substances such as powders or liquids benefit from being stored in a concentrated form until mixed with another substance (e.g., water or another liquid or other material) in the container just prior to use or consumption. Current powders or liquids may be stored in a package that cannot easily be opened by a user and combined with another substance stored in a container in a clean manner. Furthermore, current powders or additives may be stored in a package that cannot easily be used with a wide variety of containers having different sized container openings.

The inventors of the present invention have determined that it would be desirable to provide a single dose dispensing system for substances that may be used with a variety of containers having differently sized container openings. The inventors of the present invention have further found that it would be beneficial to provide a dispensing system that would be easily and ergonomically actuated by a user.

The inventors of the present invention have also determined that, in many applications, it may be desirable to provide an improved dispensing system that minimizes the likelihood of inadvertent opening of the dispensing system during shipping or handling wherein the improved dispensing system eliminates the need for any additional protective packaging, such as a larger box or carton, or the inclusion of dampening structures or inserts that would otherwise be included to minimize the likelihood of the inadvertent actuation of the dispensing system.

The inventors of the present invention have also determined that it would be desirable to provide an improved dispensing system that (1) minimizes the likelihood of inadvertent actuation of the dispensing system during shipping or handling, and (2) would actuate only when engaged by a user applying a specific, yet simple, action.

In addition, the inventors of the present invention have determined that, in many applications, it may be desirable to provide an improved dispensing system that minimizes the potential for accumulation of residue, spilled contents, etc. during the use of the system to dispense a stored substance into a container.

Further, the inventors of the present invention have determined that it would be beneficial in many applications to provide an improved dispensing system that can include or exhibit one or more of the following additional features or capabilities: (1) substantially universal compatibility with many types of sizes of containers (especially water bottles) without the need for the consumer to recognize and select a container having a particular neck size; and (2) a small format and size that permits the user to easily carry only the dispensing system on his or her person to another location where the user can then procure a container with which to use the dispensing system at the user's choice of location.

Also, the inventors of the present invention have determined that it can be beneficial for a supplier of an additive to sell and ship a separate, smaller concentrated additive dispensing package without a larger container that would be required for a pre-mixed product containing the additive already combined with another substance (e.g., water). This could provide savings in transportation costs and could advantageously allow the user or consumer to decide when, where, and into what other product to dispense the additive.

Further, the inventors of the present invention have determined that it can be desirable in some applications to provide such an improved dispensing system that accommodates dispensing a substance directly onto a target area or region, such as onto food on a plate or held in the hand, as well as, or instead of, into another substance stored in the interior of a container.

The inventors of the present invention have also determined that it would be desirable to provide an improved dispensing system that can be configured for use with dispensing a stored substance into a container of a fluent substance so as to have one or more of the following advantages: (1) an improved ease of manufacture and/or assembly, and (ii) a reduced cost of manufacture and/or assembly.

The inventors of the present invention have invented a novel structure for a dispensing system for use with dispensing a stored substance into a container, or onto some other target region, wherein the system includes various advantageous features not heretofore taught or contemplated by the prior art.

BRIEF SUMMARY OF THE INVENTION

According to broad aspects of one form of the present invention, a dispensing system is provided for use in dispensing a substance that may be stored within the system. The system includes a body having an outer wall defining an interior surface, an exterior surface, and a volume for storing a substance. The outer wall has an open top end and a sealed bottom end. The system includes a flexible lid that is connected to the body to cover the open top end. The lid has a press portion for being engaged by a user of the system. The lid has a first position and a second position moved relative to the first position, wherein in the second position at least a portion of the lid is deflected toward the sealed bottom end of the body. The system further includes a post connected to at least one of the body or the lid. Preferably, the post is connected to the lid. The post is configured in the second position of the lid to breach the sealed bottom end of the body to create a dispensing orifice to accommodate movement of a substance out of the body.

In one aspect of the present invention, the post is formed unitarily with the lid.

According to another aspect of the present invention, the lid includes at least one raised annular portion and at least one recessed annular portion surrounding the press portion.

In one aspect of the present invention, the sealed bottom end of the body includes a frangible portion of the body that is breached by movement of the post into the second position of the lid to create the dispensing orifice.

In one aspect of the present invention, the sealed bottom end of the body includes a bottom aperture in the body and further includes a bottom liner that is sealed over the bottom aperture.

According to another aspect of the present invention, the exterior surface of the outer wall defines at least one annular shoulder to accommodate supporting the body atop a variety of containers, such containers having different-sized openings, and preferably defines a plurality of vertically-spaced annular shoulders that increase in size from the sealed bottom end to the top end of the outer wall.

According to yet another aspect of the present invention, the exterior surface of the outer wall defines a convex curve to accommodate container openings differing in size.

In one form of the present invention, the dispensing system further includes a ring-shaped foil liner sealed between the lid and the body.

In another form of the present invention, the lid is inherently biased to its first position.

In still another form of the present invention, the dispensing system is provided in combination with a fluent substance, the system and the fluent substance together defining a package.

In one aspect of the present invention, the sealed bottom end includes a pair of intersecting lines of reduced thickness material and four petals defined between the intersecting lines.

According to yet another aspect of the present invention, the dispensing system is provided in combination with a pod containing a fluent substance, whereby the system, the pod, and the fluent substance together define a package.

It should be appreciated that the invention may include any or all of the above-described features, include only one of the above features, more than one of the above features, and any combination of the above features. Furthermore, other objects, features and advantages of the invention will become apparent from a review of the entire specification including the appended claims and drawings.

BRIEF DESCRIPTION OF THE DRAWINGS

In the accompanying drawings forming part of the specification, in which like numerals are employed to designate like parts throughout the same, FIG. 1 shows the lid, foil liner, and body of the system prior to assembly;

FIG. 2 shows the system with the lid, foil liner, and body assembled;

FIG. 11 shows the system actuated whereby the post has been moved into and through a sealed bottom end of the body of the system;

FIG. 12 shows the system actuated whereby the post has been moved into and through a sealed bottom end of the body of the system;

FIG. 13 shows the system actuated whereby the post has been moved into and through a sealed bottom end of the body of the system;

FIG. 14 shows the system actuated whereby the post has been moved into and through a sealed bottom end of the body of the system;

FIG. 15 shows the lid, top and bottom foil liners, and body of the system prior to assembly;

FIG. 20 shows the system actuated whereby the post has been moved into and through a sealed bottom end of the body of the system.

DESCRIPTION OF THE PREFERRED EMBODIMENT

While this invention is susceptible of embodiment in many different forms, this specification and the accompanying drawings disclose only specific forms as examples of the invention. The invention is not intended to be limited to the embodiments so described, and the scope of the invention will be pointed out in the appended claims.

Figure 10:
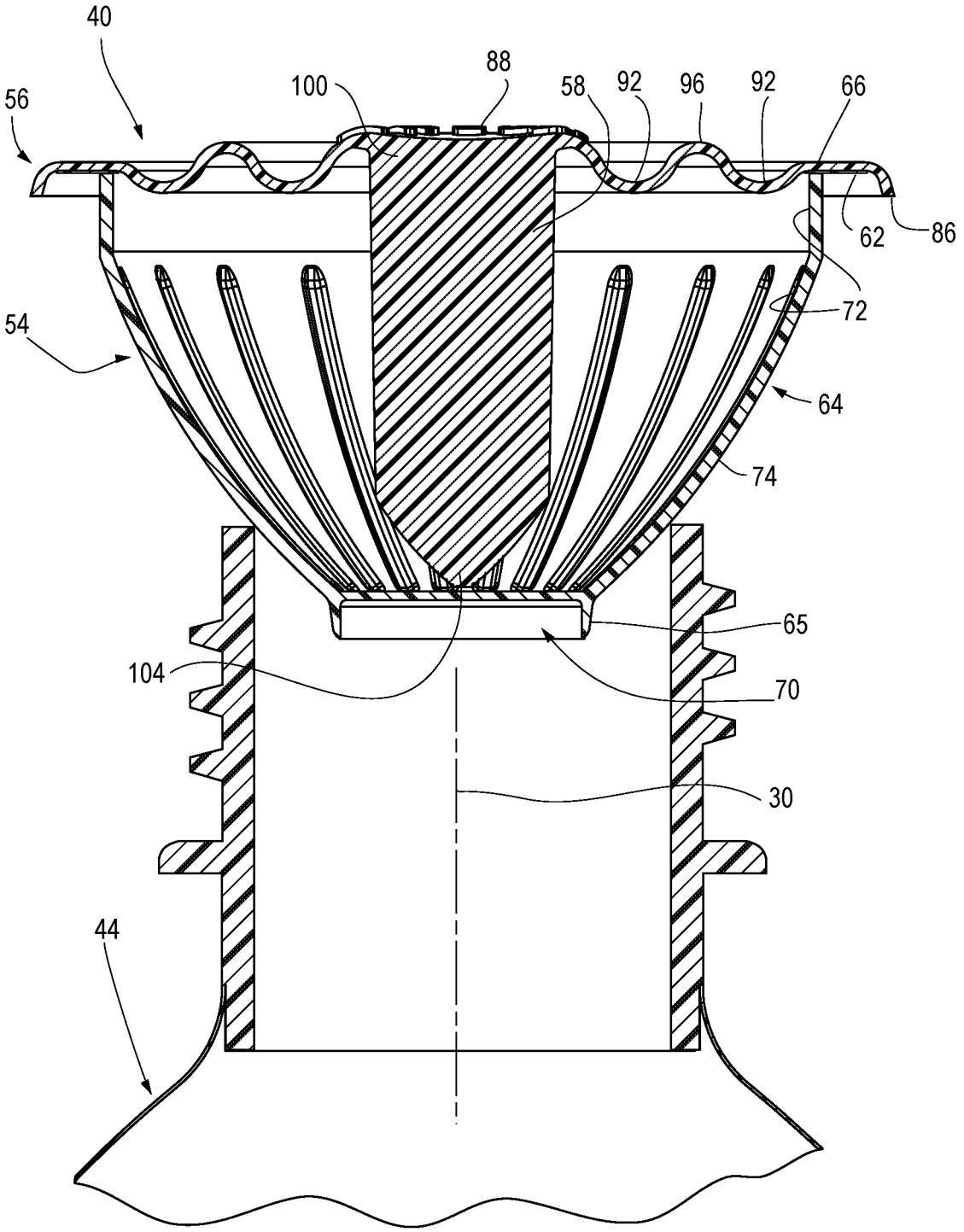
FIG. 10 is an enlarged, fragmentary, cross-sectional view of the system and the upper portion of the container, taken generally along plane 10-10 in FIG. 9.

For ease of description, many figures illustrating the invention show embodiments of a dispensing system in the typical orientation that the system would have when located at the opening of a container such as an upright bottle, and terms such as "inward", "outward", "upper", "lower", "axial", "radial", "lateral", etc., are used with reference to this orientation. The term "axially inward" is to be understood as in the direction along a central axis 30 (visible in FIG. 1) of the system, toward the interior of the container (FIG. 10). The term "axially outward" is to be understood as in the direction along a central axis 30, away from the interior of the container (FIG. 10). The term "radially inward" is to be understood as in the radial direction toward the central axis 30. The term "radially outward" is to be understood as in the radial direction away from the central axis 30. The term "laterally inward" is to be understood as in a direction toward the central axis 30, in a plane normal to the central axis 30. The term "laterally outward" is to be understood as in a direction away from the central axis 30, in a plane normal to the central axis 30. It will be understood, however, that the system of this invention may be manufactured, stored, transported, used, and sold in an orientation other than the specific orientation described and illustrated.

The dispensing systems of this invention are especially suitable for use with a variety of conventional or special containers, the details of which, although not fully illustrated or described, would be apparent to those having skill in the art and an understanding of such containers. The particular container illustrated is not intended to limit the present invention. It will also be understood by those of ordinary skill that novel and non-obvious inventive aspects are embodied in the described systems alone.

The dispensing systems described herein are especially suitable for use in dispensing a fluent substance as an additive into a container that contains a liquid such as water. Such dispensed fluent substances may be, for example, food additives, a personal care product, an industrial product, a household product, or other types of products. Such substances may be for internal or external use by humans or animals, or for other uses (e.g., activities involving medicine, commercial or household maintenance, agriculture, manufacturing, etc.).

A first embodiment of a dispensing system of the present invention is illustrated in FIGS. 1-14, wherein the system is designated generally by the reference number 40. The first illustrated embodiment of the system 40 has the form of a self-contained article or package that is configured to be (i) selectively placed at an opening of a container 44 (FIG. 8) and (ii) actuated to dispense a fluent substance such as a concentrated powder into the container 44. The container 44 illustrated in FIGS. 8-11 has the form of a bottle that would typically contain another fluent substance (e.g., water). The fluent substance to be dispensed from the system 40 is not illustrated in the figures because the substance may take a variety of forms. The container 44 shown in FIGS. 8-11 is typically provided initially with a cap or other closure (not illustrated) that can be removably mounted to the container with threads for mating with threads 45 on the container 44. The closure is first removed by the user prior to the user placing the system 40 on the opening of the container 44. Closure mounting features other than mating threads could be used, such as snap-fit beads and grooves, toggle clamps, friction fittings, etc.

It will be understood that the container may be any conventional type, such as a collapsible, flexible pouch, or may be a generally rigid bottle that has somewhat flexible, resilient walls. It will further be understood that, for some applications, the system 40 may be used to dispense a substance outside of, or apart from, a container—such as directly onto a target area (e.g., a hand held item of food or other material).

The container, or a portion thereof, may be made from a material suitable for the intended application. For example, the container may be a pouch made from a thin, flexible material (wherein such a material could be a polyethylene terephthalate (PET) film or a polyethylene film and/or an aluminum foil). Alternatively, a more rigid container (e.g., a bottle) could be made from a thicker, less flexible material such as molded polyethylene, polypropylene, polyethylene terephthalate, polyvinylchloride, glass, metal, or other materials.

It is contemplated that typically, after the dispensing system manufacturer would make the dispensing system 40 (e.g., by molding its components from a thermoplastic polymer), the manufacturer will then ship the unassembled components of the dispensing system 40 to a filler facility at another location where the system 40 would be filled with a product and sealed in the form of a package that would be encountered by a customer or user of the system 40.

Figure 1:
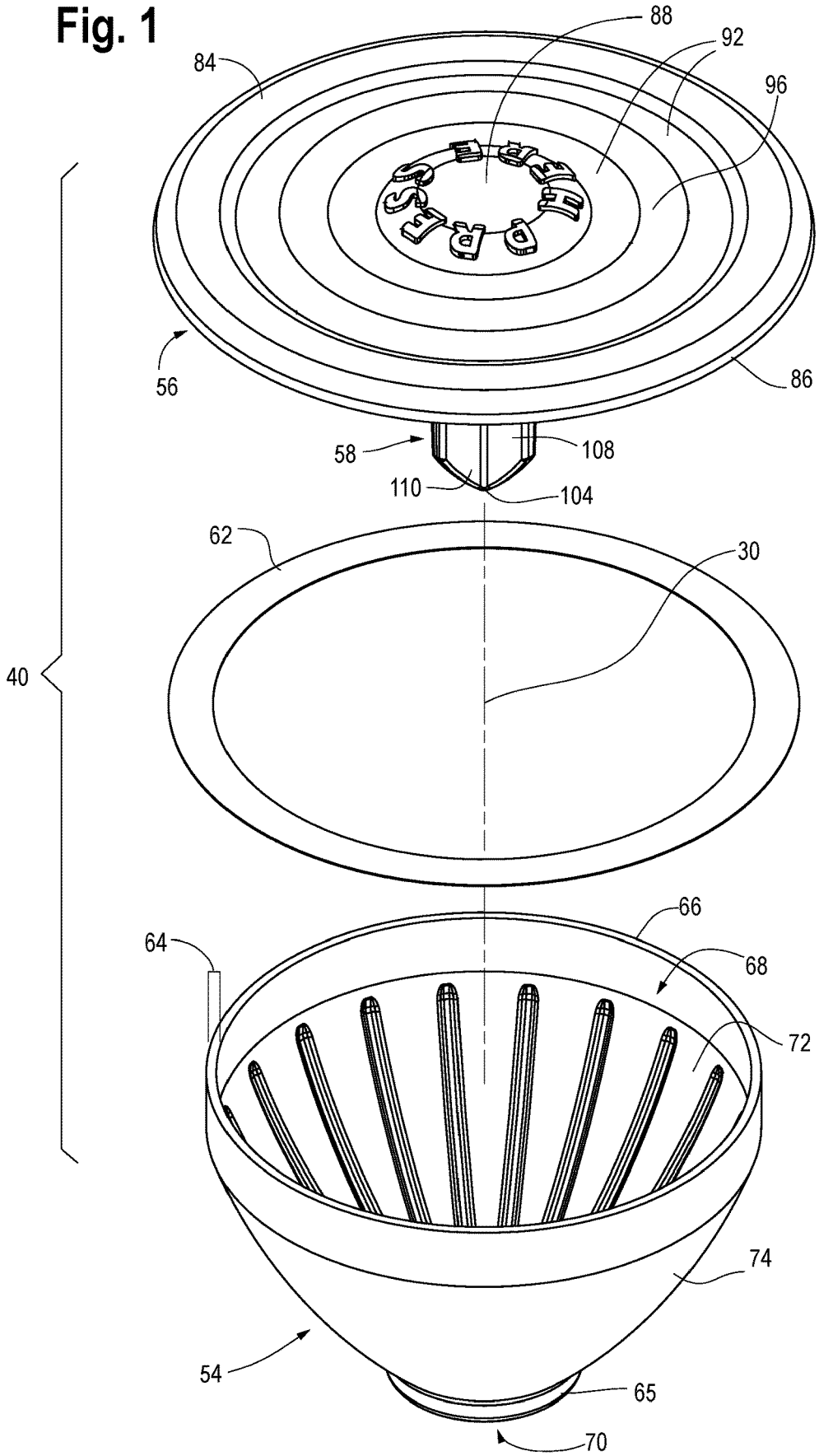
FIG. 1 is an enlarged, exploded, perspective view of a first embodiment of a dispensing system of the present invention.
Figure 11:
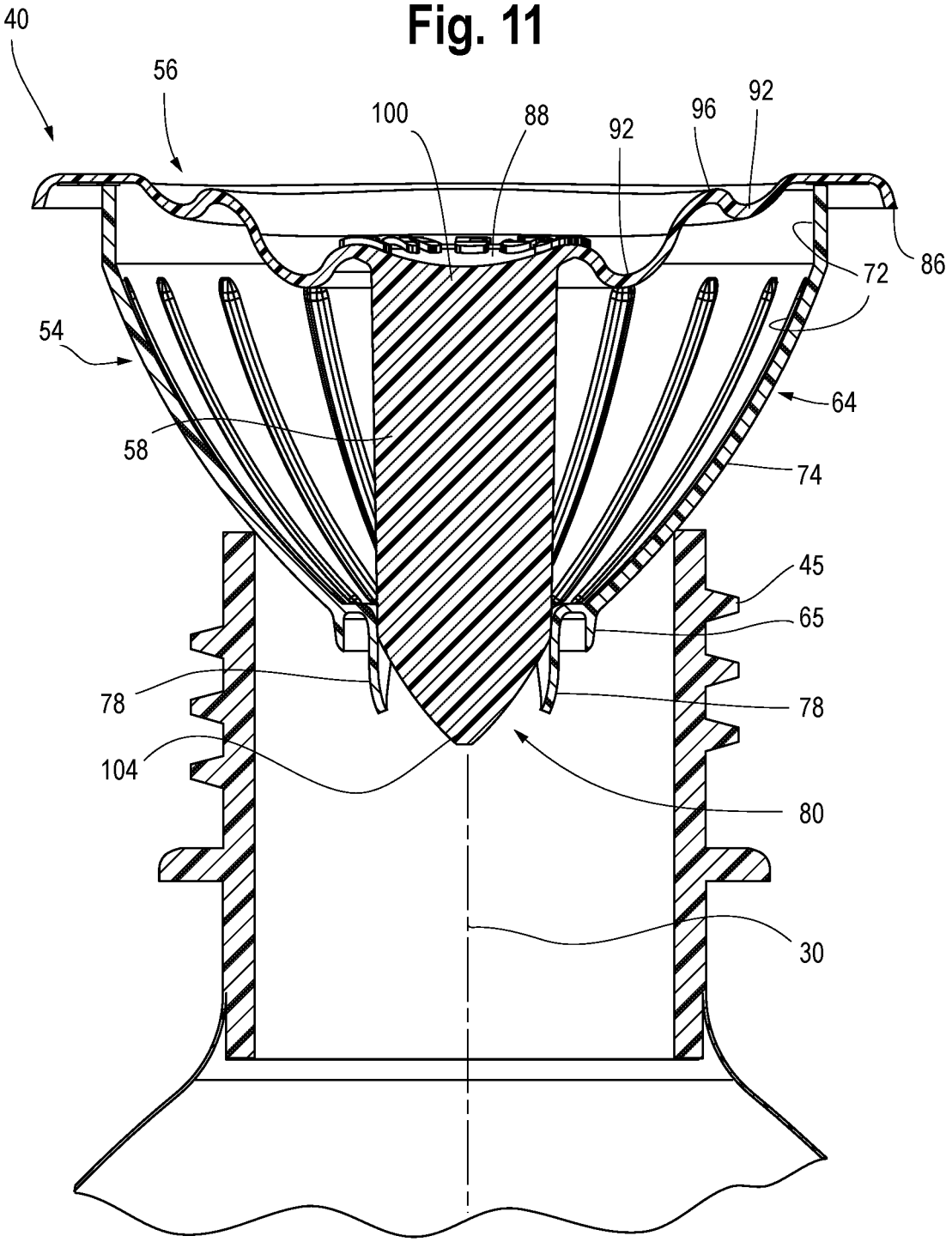
FIG. 11 is an enlarged, fragmentary, cross-sectional view of the system and the upper portion of the container that is similar to FIG. 10, however
Figure 12:
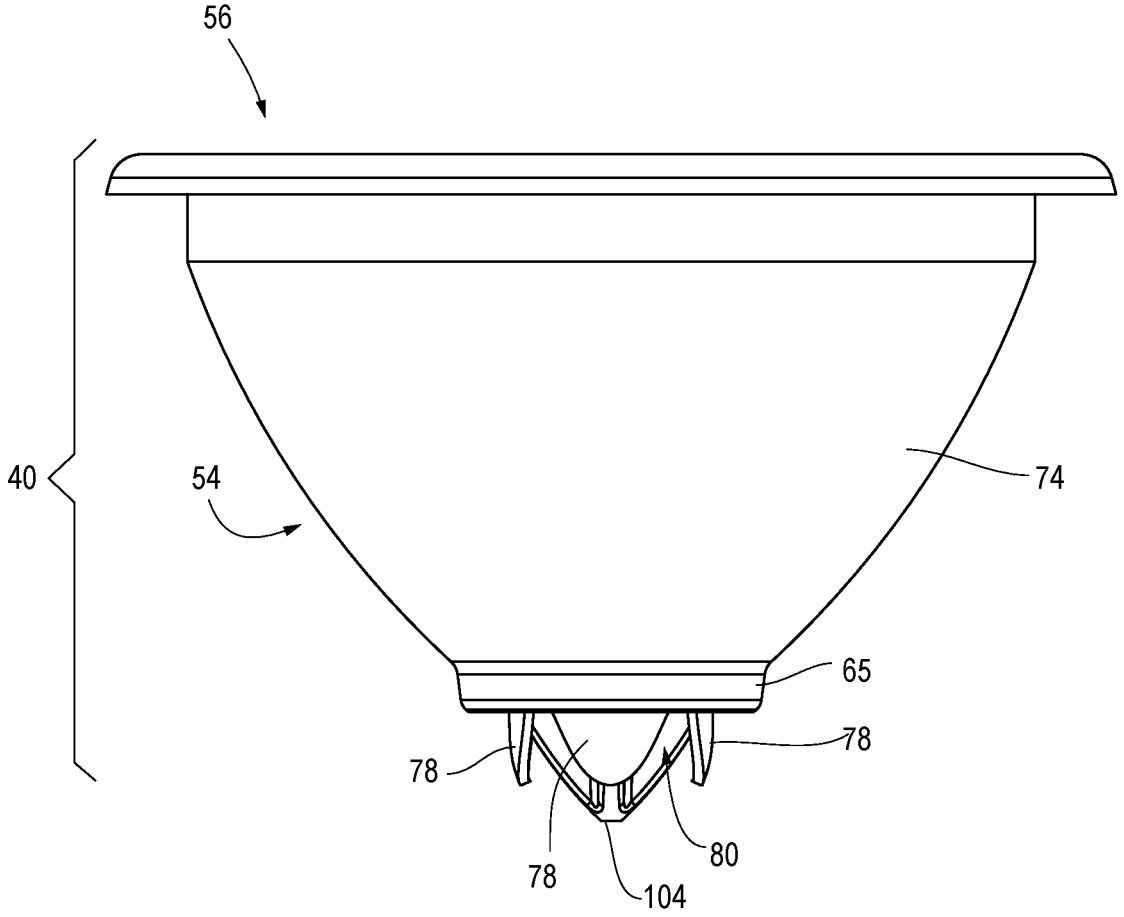
FIG. 12 is an enlarged, side-elevation view of the system similar to FIG. 9, however
Figure 13:
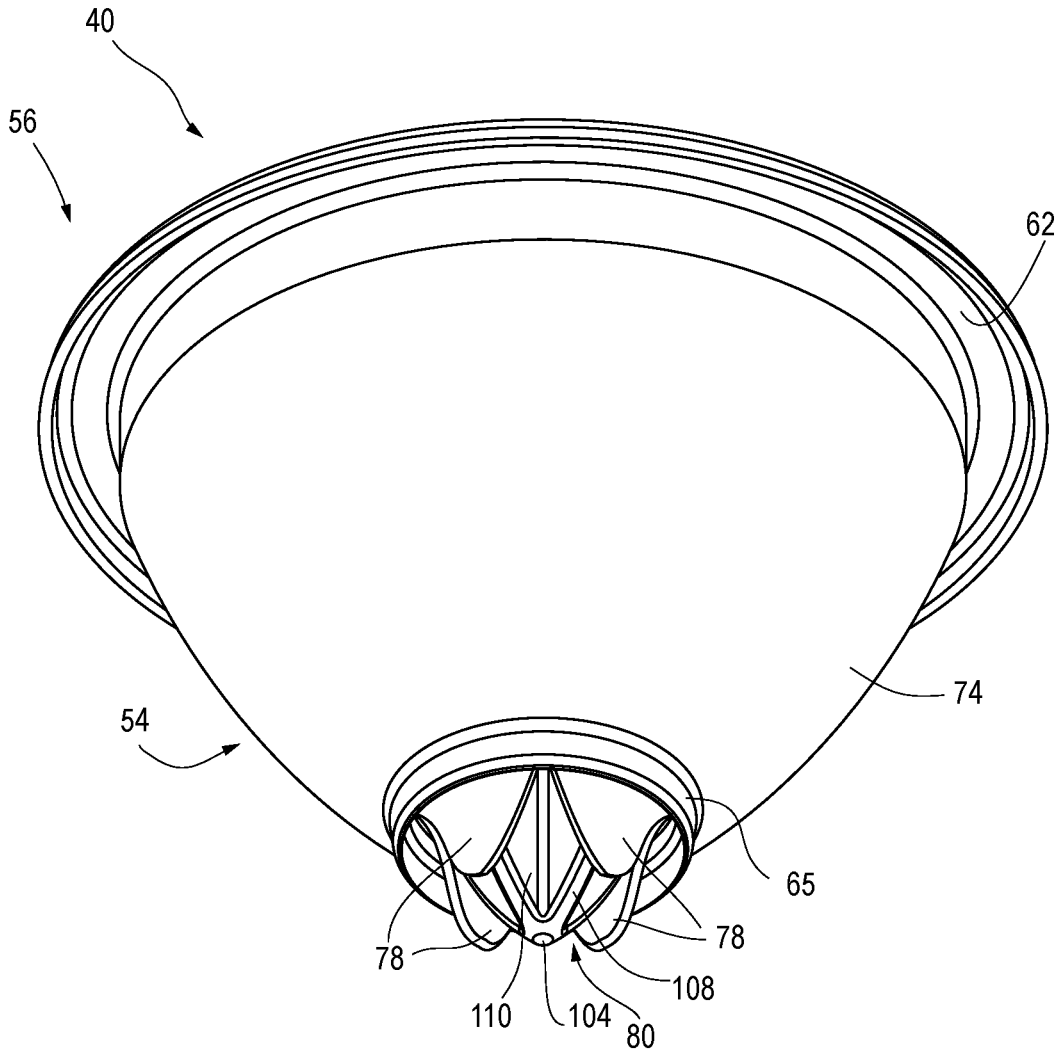
FIG. 13 is an enlarged, perspective view of the system, taken from below, similar to FIG. 3, however
Figure 14:
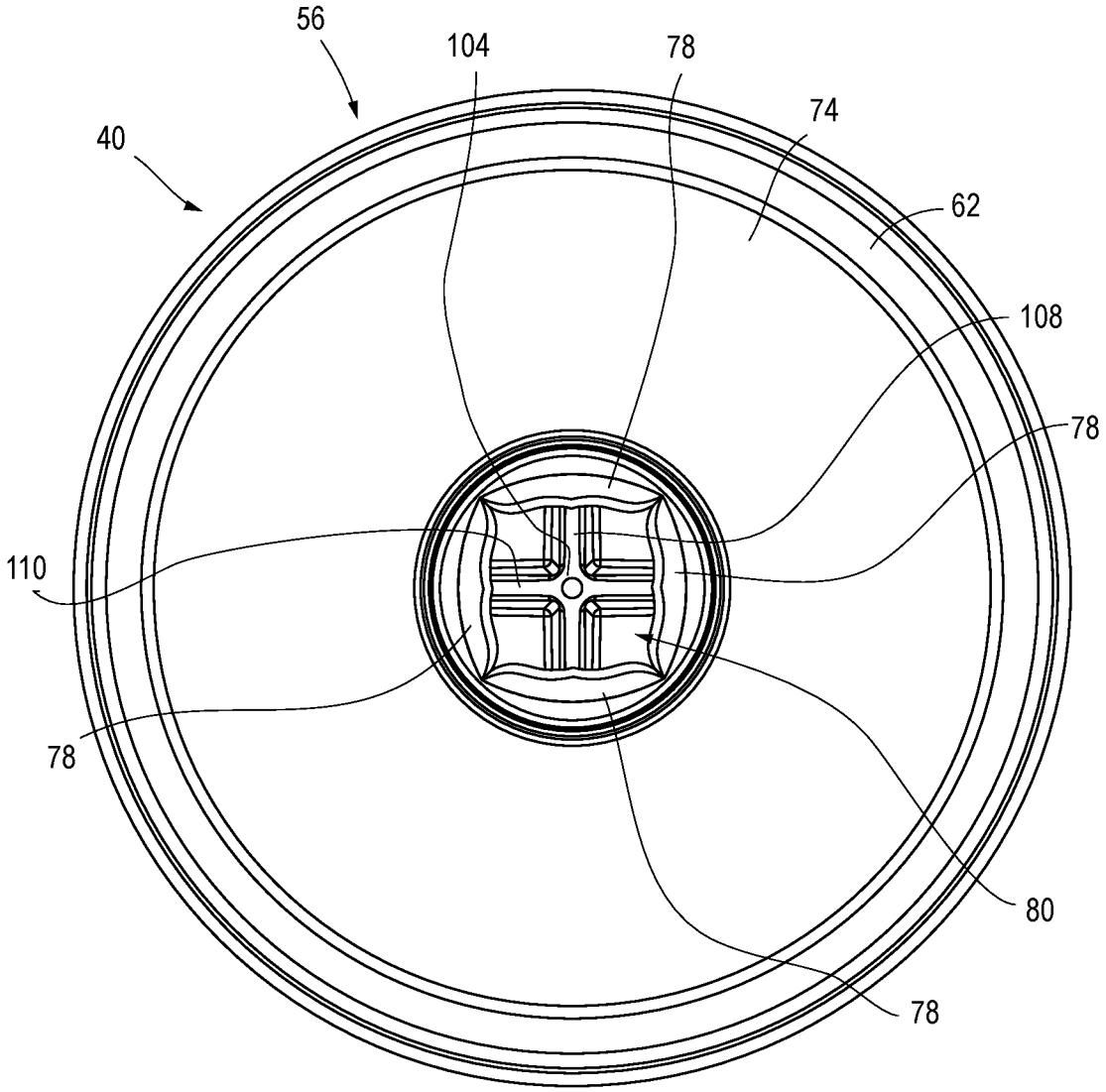
FIG. 14 is an enlarged, a bottom plan view of the system similar to FIG. 6, however

With reference now to FIGS. 1, 10, and 11, the first illustrated embodiment of the dispensing system 40 includes the following basic components: a base or body 54; and a flexible lid 56 that is mounted atop the body 54, wherein the lid 56 includes a post 58 extending into the hollow interior of the body 54. The body 54 defines a volume for storing a fluent substance to be dispensed. Along the axis 30, the lid 56 is flexible (e.g., resiliently deflectable or in some alternative embodiments permanently deformable), whereby the lid 56 has an unactuated, first position (FIG. 10) and may be pressed by a finger or thumb of a user of the dispensing system 40 to move the lid 56 into an actuated, second position (FIG. 11). Movement of the lid 56 axially inwardly or downwardly into its second position causes the post 58 to breach a bottom portion or bottom seal on the body 54 to form a dispensing orifice to permit the dispensing of the stored substance from the system 40.

Preferably, the dispensing orifice created by the movement of the post 58 may be located at the opening of a container 44 or a target area so that the user can dispense the substance stored within the system 40 to the container 44 or target area.

The body 54, lid 56, and post 58 are preferably formed or molded from a suitable thermoplastic material such as polypropylene or polyethylene. Other materials may be employed instead. It will be understood that in alternative designs (not illustrated), one or more of the basic components or sub-components may be separately or sequentially formed or molded (such as through bi-injection molding). Alternatively, the basic components may be molded initially as one connected, unitary structure, and then broken apart, and then re-assembled into an operative combination or assembly.

With reference to FIGS. 1 and 10, the lid 56 is connected to the body 54 of the system 40 by a ring-like foil or composite liner 62 which can be permanently sealed to, and between, the lid 56 and the body 54 by use of radio-frequency welding or an induction heating process. An exemplary foil liner is described in the U.S. Pat. No. 7,721,901, the disclosure of which is incorporated herein in its entirety. In some applications, the liner 62 may be omitted, and the lid 56 may be removably or non-removably connected to the body 54 by a hinge, a screw thread, a tether, adhesive, heat weld, or a snap fit connection, etc. (not illustrated). In alternative embodiments, the lid 56 may be unitarily formed with the body 54.

Referring now to FIG. 1, the closure body 54 includes an outer wall 64 having a top end 66 defining a circular opening 68. The outer wall 64 further defines a sealed bottom end 70 (visible in FIGS. 3 and 7). The outer wall 64 defines an interior surface 72 and an exterior surface 74. The interior of the body 54 defines a volume for storing a fluent substance. The body 54 has a cup-like shape, and the exterior surface 74 and defines a sloping, convex curve for accommodating differently-sized openings or neck finishes of different containers. The sealed bottom end 70 of the body 54 is adapted to be located at the opening of a container, such as the container 44 (FIG. 10), so as to communicate with an interior of the container 44, as will be discussed in greater detail herein.

The inventors have found that the body 54—having an exterior surface 74 that includes a sloping, convex curve—accommodates the placement of the sealed bottom end 70 atop a large variety of standard and non-standard containers with varying sizes of openings or neck finishes. Furthermore, the user of the dispensing system 40 need not be educated about, or otherwise made aware of, the variability of container openings or neck finishes that exist on the market. An annular wall 65 (FIGS. 3 and 10) extends around the sealed bottom end 70 to further assist in centering and maintaining the dispensing system 40 at the openings of some containers.

Figure 6:
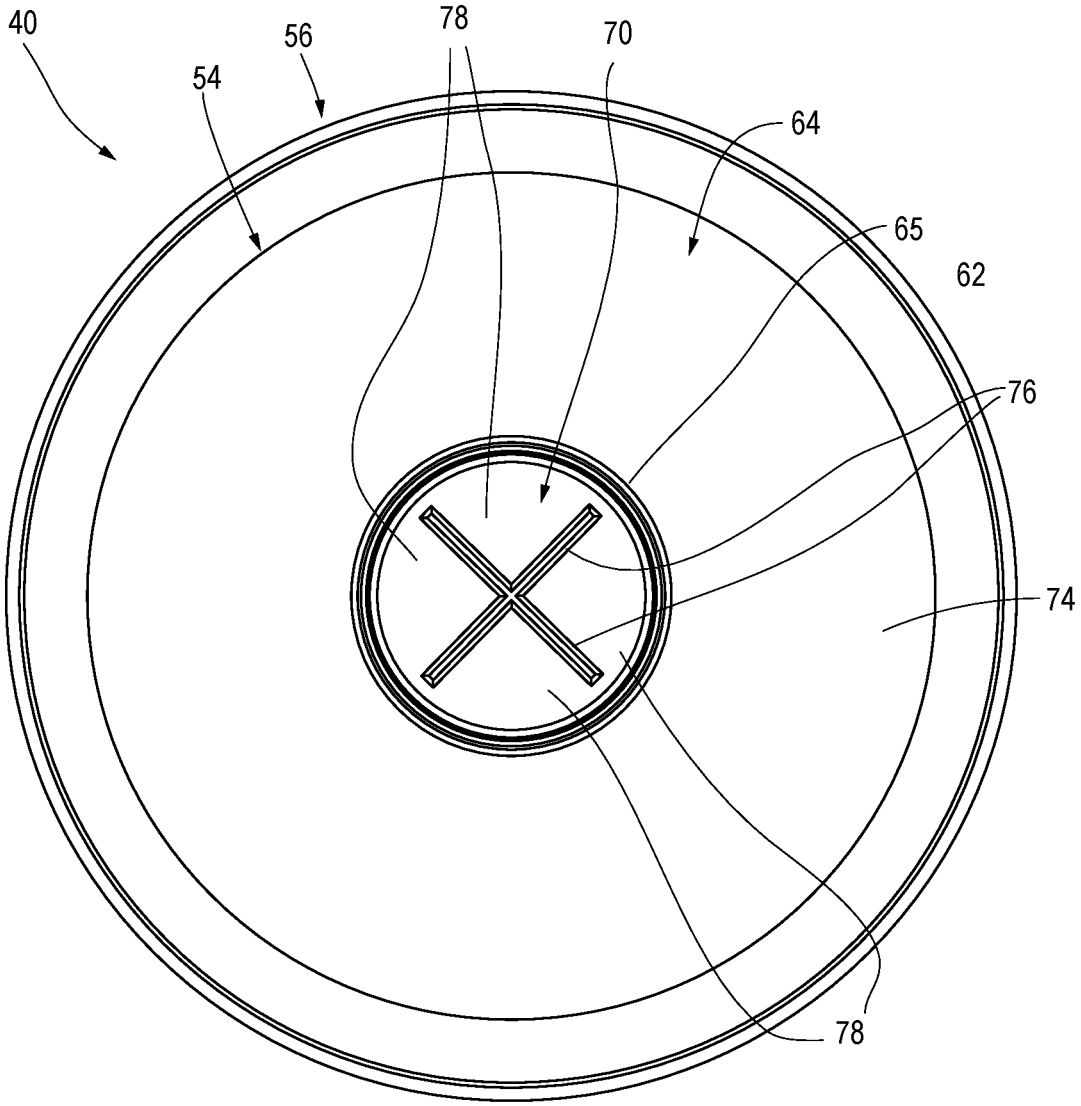
FIG. 6 is an enlarged, bottom plan view of the system illustrated in FIG. 2.

With reference now to FIG. 6, the sealed bottom end 70 includes a frangible region of material in the form of a pair of reduced-thickness intersecting lines or line-like features 76 that are integrally molded with the body 54 to define lines of preferential weakness. Four petals 78 extend between the intersecting lines 76. As will be discussed in greater detail hereinafter, the intersecting lines 76 are configured to rupture when engaged by the post 58 (FIGS. 11-14), which causes the petals 78 to open axially downward. Opening of the petals 78 defines a dispensing orifice 80 (FIG. 13) in the bottom of the body 54 to permit flow of a substance from the interior of the body 54 to the exterior of the body 54.

The inventors of the present invention have found that molding the sealed bottom end 70 with the lines 76 to define a frangible region or portion of the body 54 advantageously eliminates the need for a secondary, separate seal that would otherwise be required to cover a body having an open-molded bottom end. This may reduce the cost of manufacture and/or assembly of the system 40, and further may increase the robustness of the system 40, after it has been assembled and filled with a product, as well as during shipping, handling, and/or storage thereof.

Figure 7:
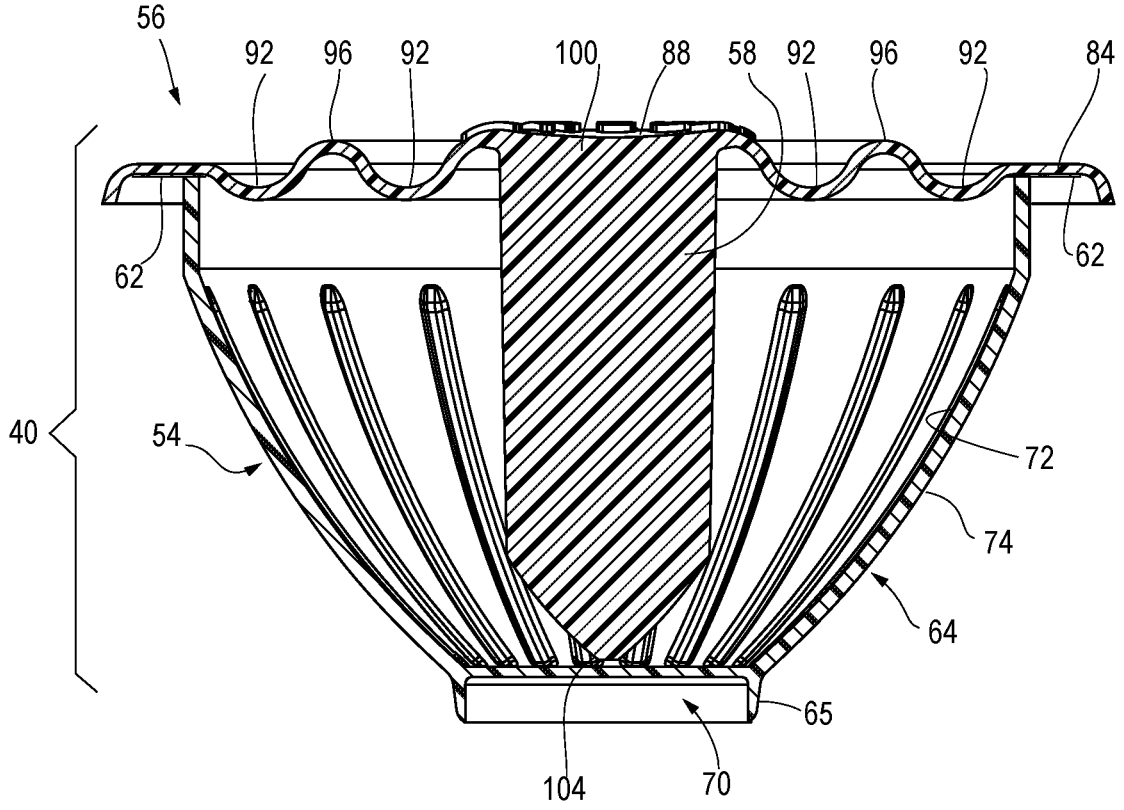
FIG. 7 is a cross-sectional view of the system, taken generally along the plane 7-7 in FIG. 5.

With reference now to FIG. 7, the lid 56 includes a generally circular top deck 84 that terminates in a lip or skirt 86, which extends laterally beyond the top end of the body wall 64 when the lid 56 is assembled together with the body 54. The lid 56 includes a press portion 88 in the center of the top deck 84 which is surrounded by a pair of recessed annular portions or channels 92 that are separated by a raised annular portion or annular ridge 96. Together, the channels 92 and the ridge 96 provide the lid 56 with a spring-like, axial flexibility and permit the lid 56 to move from its unactuated, first position (FIG. 7) to its actuated, second position (FIG. 11) when a user presses against the press portion 88.

Referring now to FIG. 7, the post 58 has a proximal end 100 that is connected to the bottom of the top deck 84 of the lid 56 and a distal end 104 located in a confronting position with respect to the sealed bottom end 70 when the lid 56 is in its first (unactuated) position. The post 58 defines a pair of intersecting walls 108, 110 (visible in FIG. 1) that taper to the distal end 104 of the post 58. As will be discussed in detail below, the intersecting walls 108, 110 are aligned with the frangible intersecting lines 76 of the sealed bottom end 70 of the body 54, such that when the lid 56 is pressed into its actuated, second position by a user of the system 40, the post 58 breaches the frangible intersecting lines 76 of the sealed bottom end 70 of the body 54 (as illustrated in FIGS. 11-14).

While the first illustrated embodiment of the system 40 shows the post 58 as being integral with, or connected to, the lid 56, it will be understood that in some applications (not illustrated) the post 58 may instead be integral with, or connected to, only body 54 and not the lid 56. One advantage of such a configuration would be that the distal end of the post 58 does not need to pass through a substance stored within the body 54 when the lid 56 moves from its unactuated, first position to its actuated, second position to breach the sealed bottom end 70. This advantageously reduces the forces required for the post 58 to breach the sealed bottom end 70 of the body 54 and does not cause the distal end of the post 58 to crush or degrade the stored substance mechanically, which may rest between the distal end of the post 58 and the sealed bottom end 70, during the substance dispensing process.

One method of assembling the system 40 is next discussed. It will be understood that the method of assembly described herein is illustrative only, and there may be other methods of assembling the components of the system 40. The body 54 and the lid 56 are preferably molded as separate articles of manufacture and shipped to a filler facility with the liner 62. The filler facility then fills the body 54 with a pre-determined amount or dose of a substance (not illustrated). The liner 62 is then placed between the top end 66 of the wall 64 and the underside of the top deck 84 of the lid 56. The filled system 40 is then placed in an induction welding line to seal the liner 62 between both the lid 56 and the body 54 to form a completed package.

Figure 2:
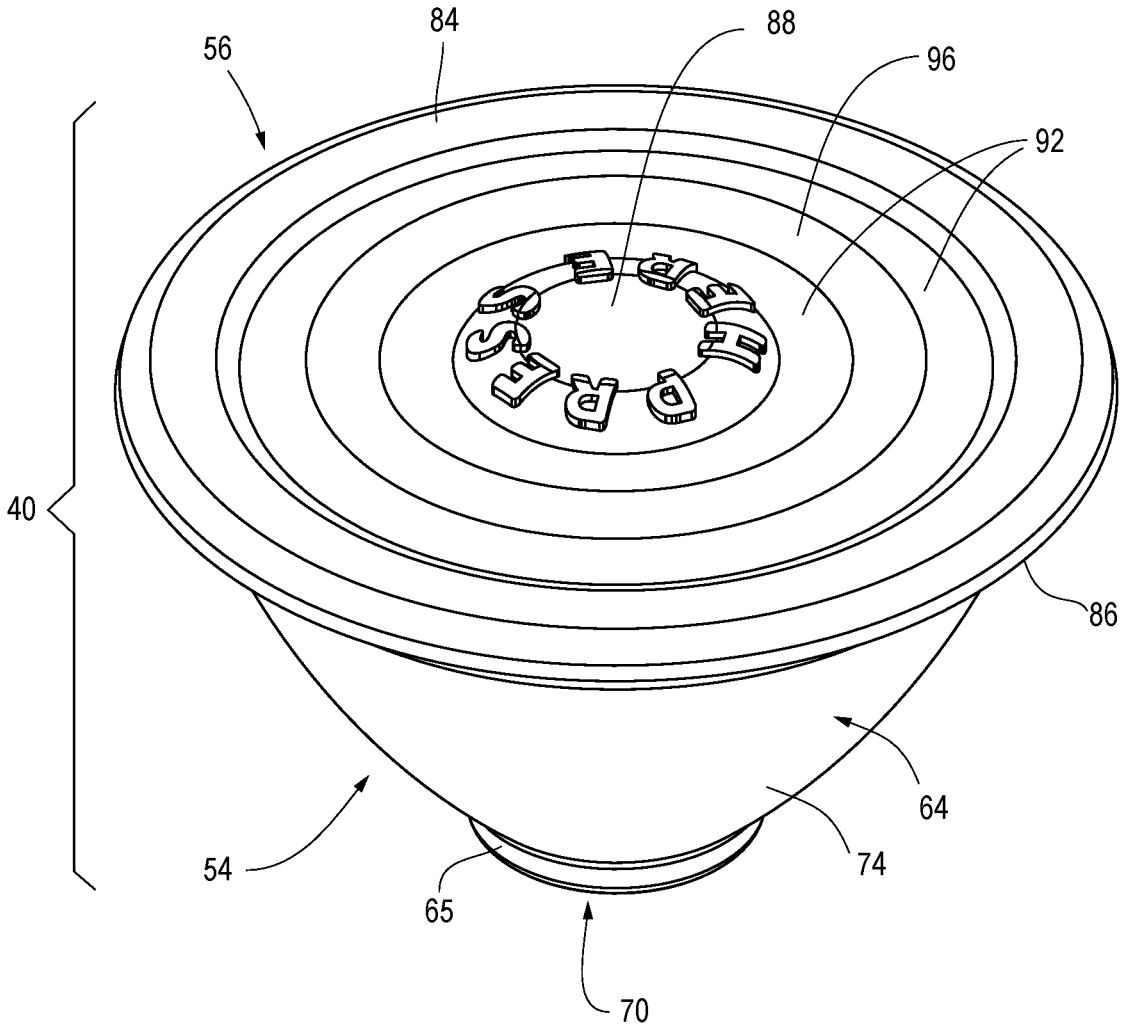
FIG. 2 is an enlarged, perspective view, taken from above, of the system shown in FIG. 1.
Figure 3:
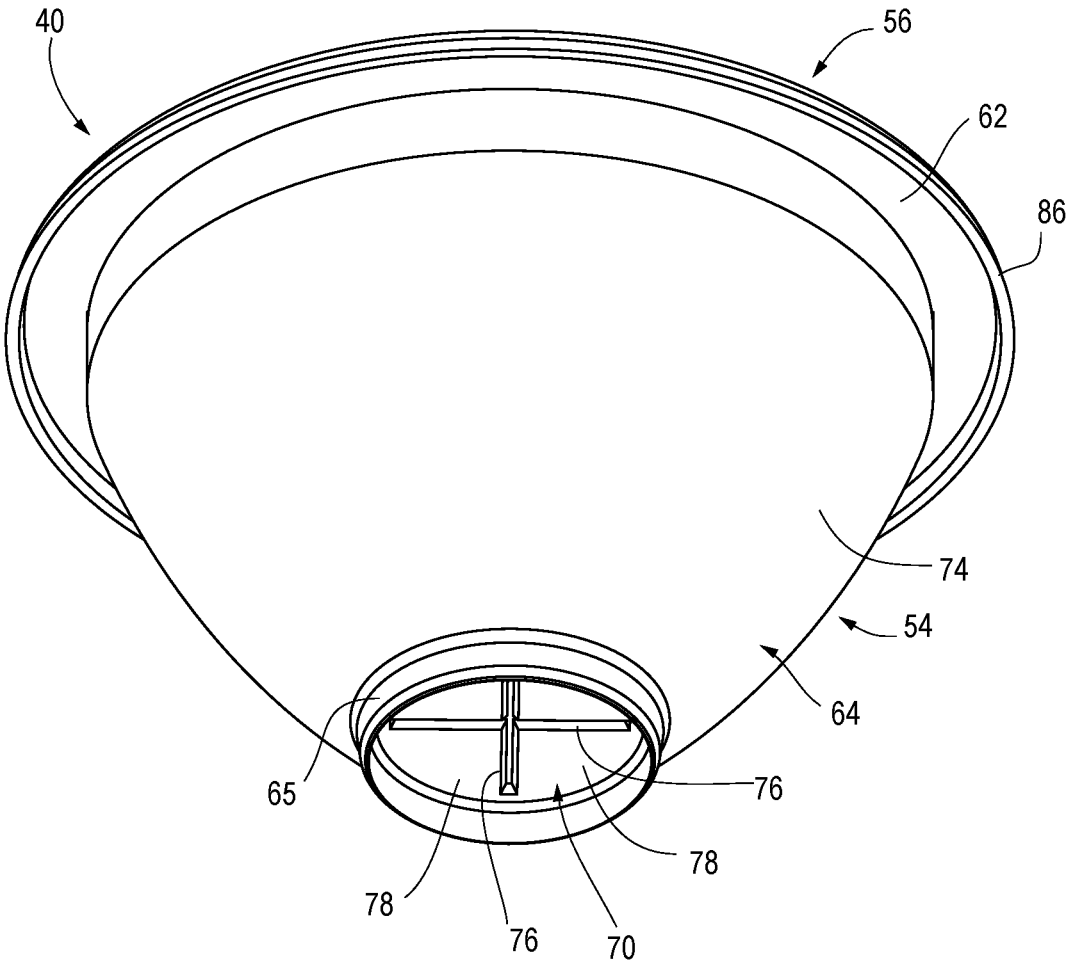
FIG. 3 is an enlarged, perspective view, taken from below, of the system shown in FIG. 2.
Figure 4:
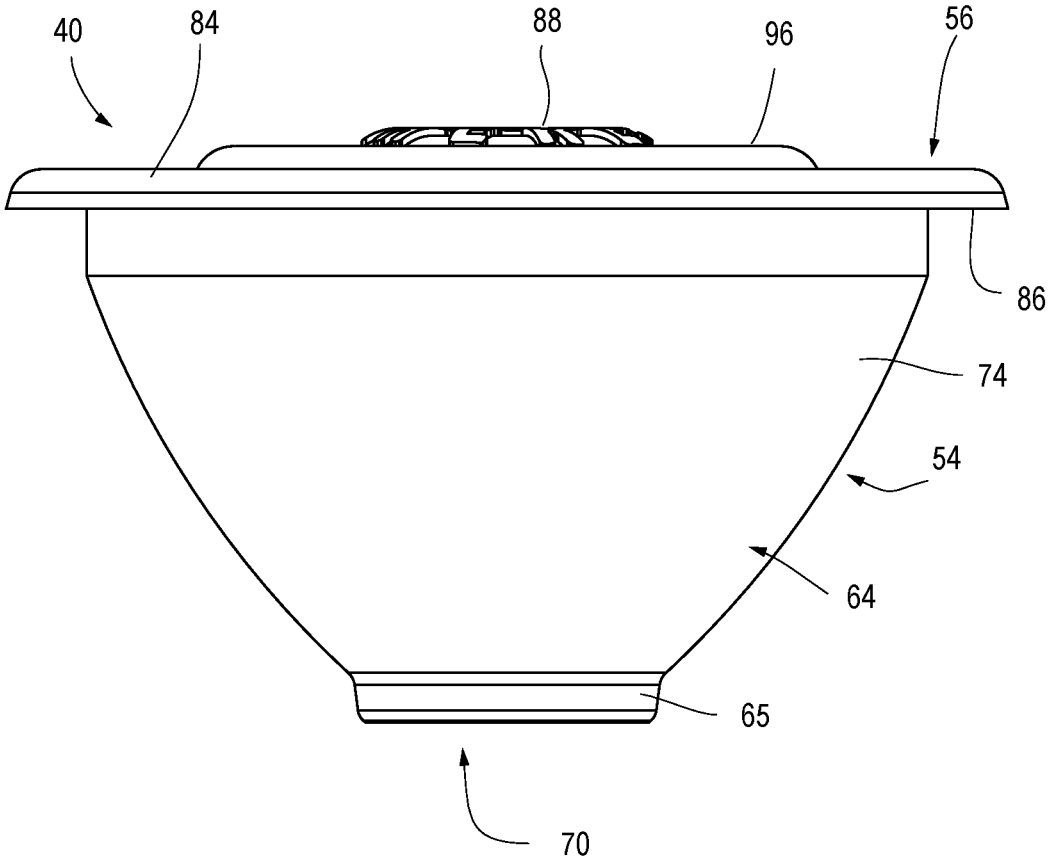
FIG. 4 is an enlarged, front elevation view of the system shown in FIG. 2.
Figure 5:
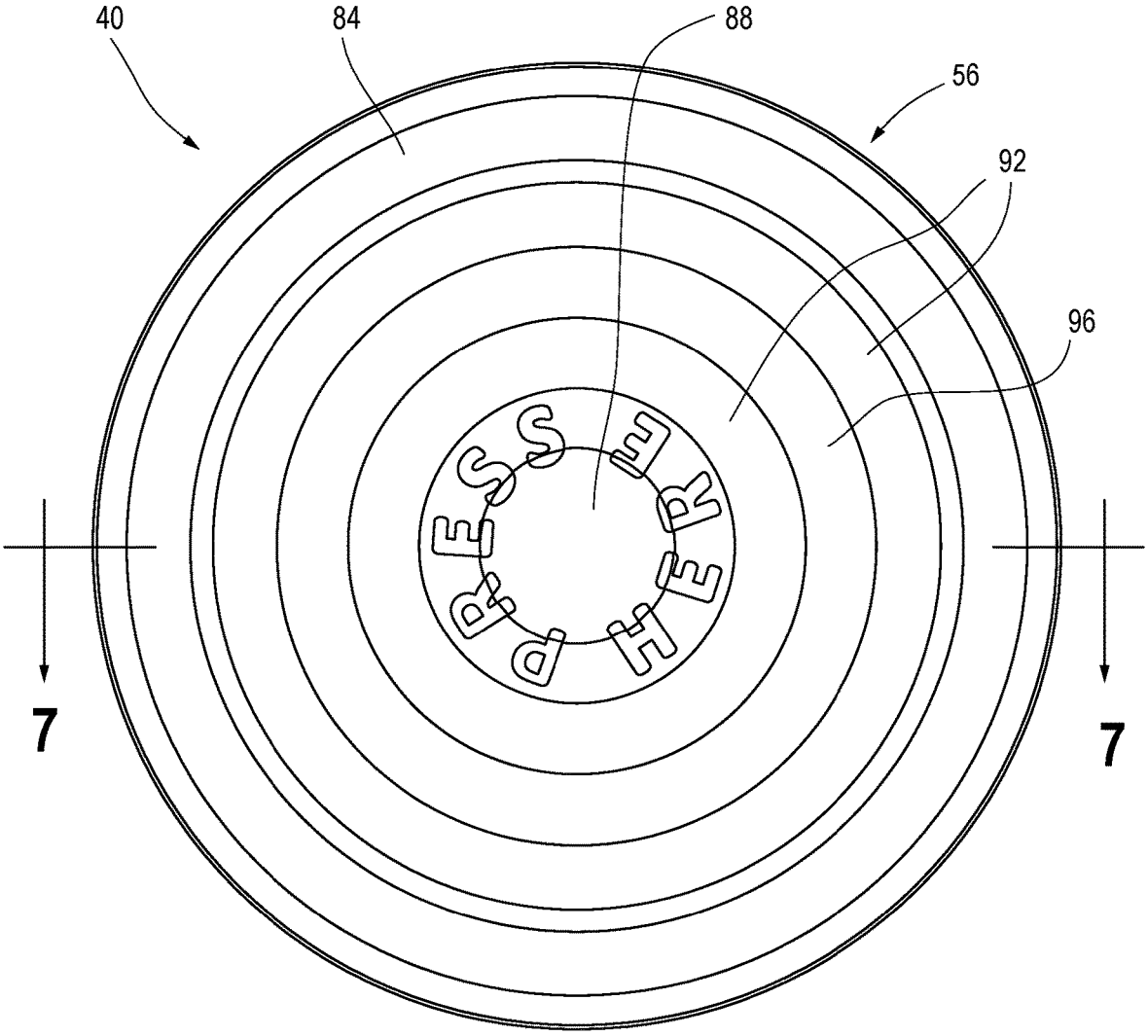
FIG. 5 is an enlarged, top plan view of the system illustrated in FIG. 2.

The detailed operation and function of the system 40 will next be described with initial reference to FIG. 2. Typically, a user, such as a customer, will encounter the system 40 as shown in FIG. 2, with the system 40 and the fluent substance contained and sealed therein defining a package.

Figure 8:
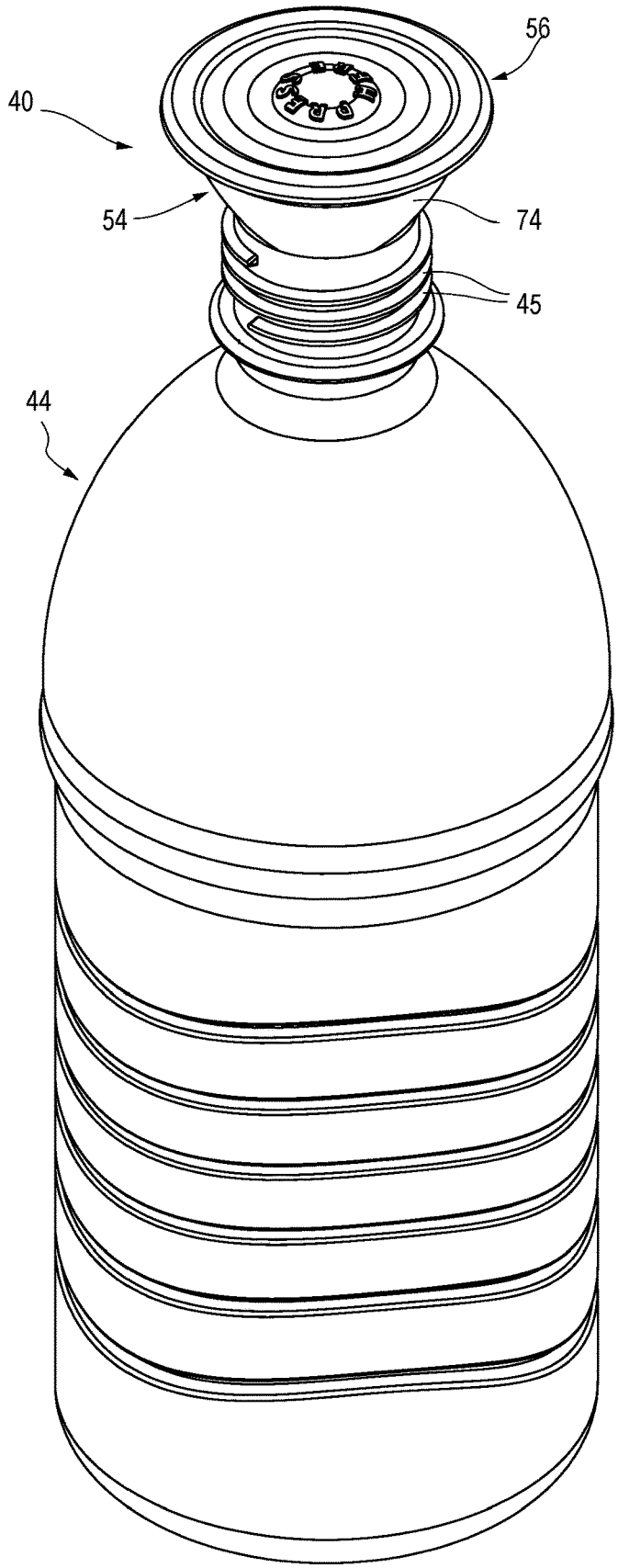
FIG. 8 is a perspective view, taken from above, of the system shown in FIG. 2 placed at the opening of a container.
Figure 9:
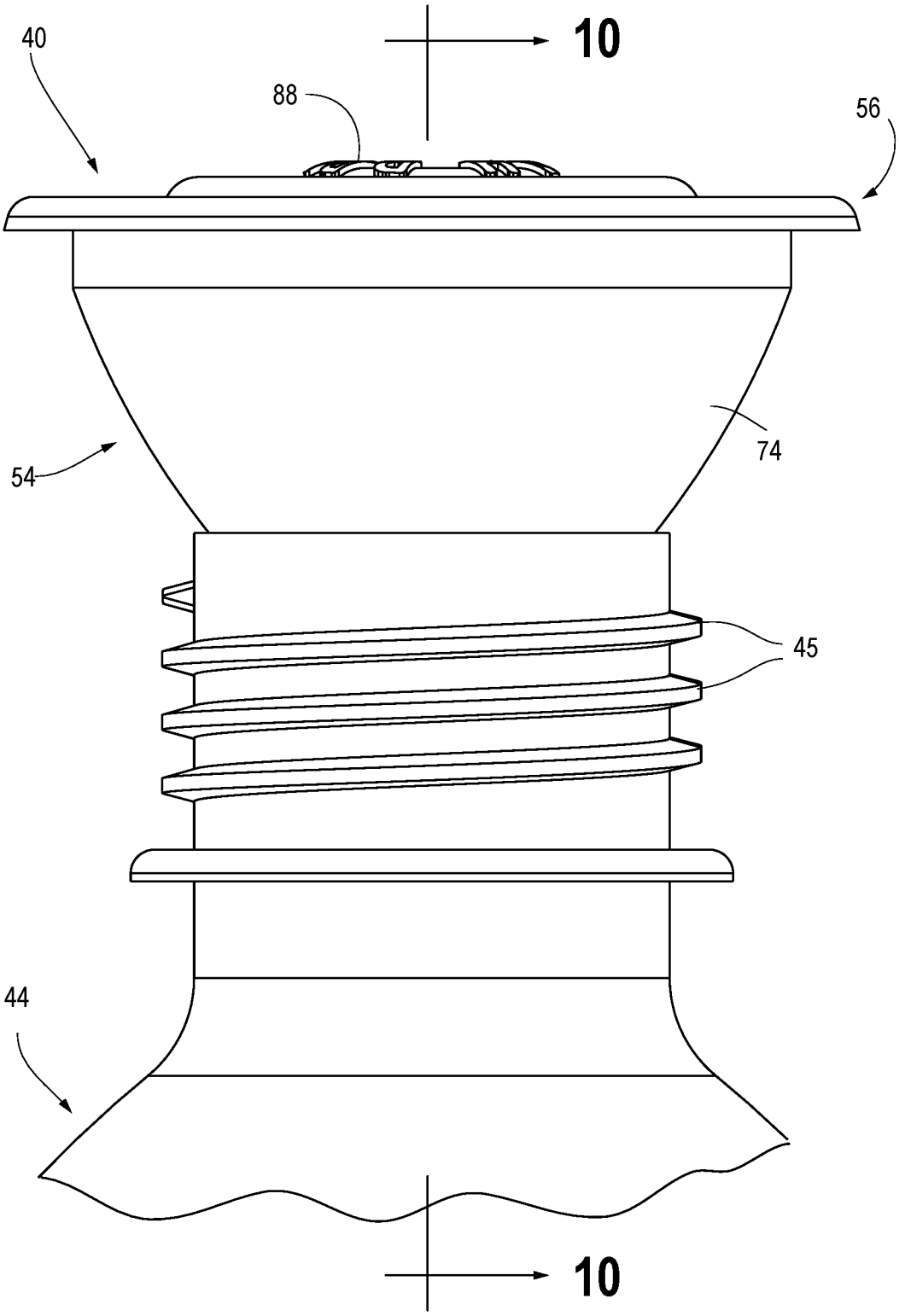
FIG. 9 is an enlarged, fragmentary, side-elevation view of the system and the upper portion of the container shown in FIG. 8.

With reference to FIGS. 8-10, the system 40 would be typically used for dispensing a substance stored within the system 40 to be dissolved within a liquid (e.g., water) that is stored in a container 44. The user would first open the container 44 by removing the closure (not shown). The user would then orient the system 40 in an upright manner atop the upright, opened container 44 such that the curved exterior surface 74 of the body 54 would rest against the container 44 at its opening (see FIGS. 8, 9, and 10). In this position, the sealed bottom end 70 of the body 54 is located at (e.g., above, within) the opening of the container 44. The convex curve of the exterior surface 74 helps to orient the body 54 and lid 56 such that so that the post 58 is generally upright and extends along the central axis 30 (FIG. 10).

With reference to FIGS. 10 and 11, the user can actuate the system 40 by gripping the body 54 and/or the container 44 and pressing with a thumb or finger against the press portion 88 on the lid 56. Application of a force upon the lid 56 will move the lid 56 from its first position (FIG. 10) into its second position (FIG. 11), and, in the process, drive down the post 58 along the axis 30. When a sufficient pre-determined force is applied to the press portion 88 to deflect it axially inwardly, the post 58 will breach the sealed bottom end 70 of the body 54. More specifically, the frangible portions along the intersecting lines 76 of the sealed bottom end 70 will rupture, and the four petals 78 will be forced by the post 58 to open axially downwardly toward the container 44 interior. A dispensing orifice 80 is thus created between the post 58 and the opened petals 78 to permit the fluent substance to exit the body 54 and enter the container 44.

It is contemplated that the one preferred form of the system 40 would be single-use, and the system 40 would be either recycled, or appropriately discarded, by the user after a single actuation or use.

The user would typically close the container 44 with the original closure cap or lid (not illustrated) and then shake the closed container 44 to mix the dispensed substance together with the liquid of the container 44, and such a mixture would be consumed or otherwise used by the user.

A second embodiment of a dispensing system according to the present invention is illustrated in FIGS. 15-20 and is designated generally by the numeral 40A. The numbered features of the second embodiment of the system 40A illustrated in FIGS. 15-20 are designated generally with the suffix letter "A" and are analogous to features of the first embodiment of the system 40 that share the same number (without the suffix letter "A").

Figure 15:
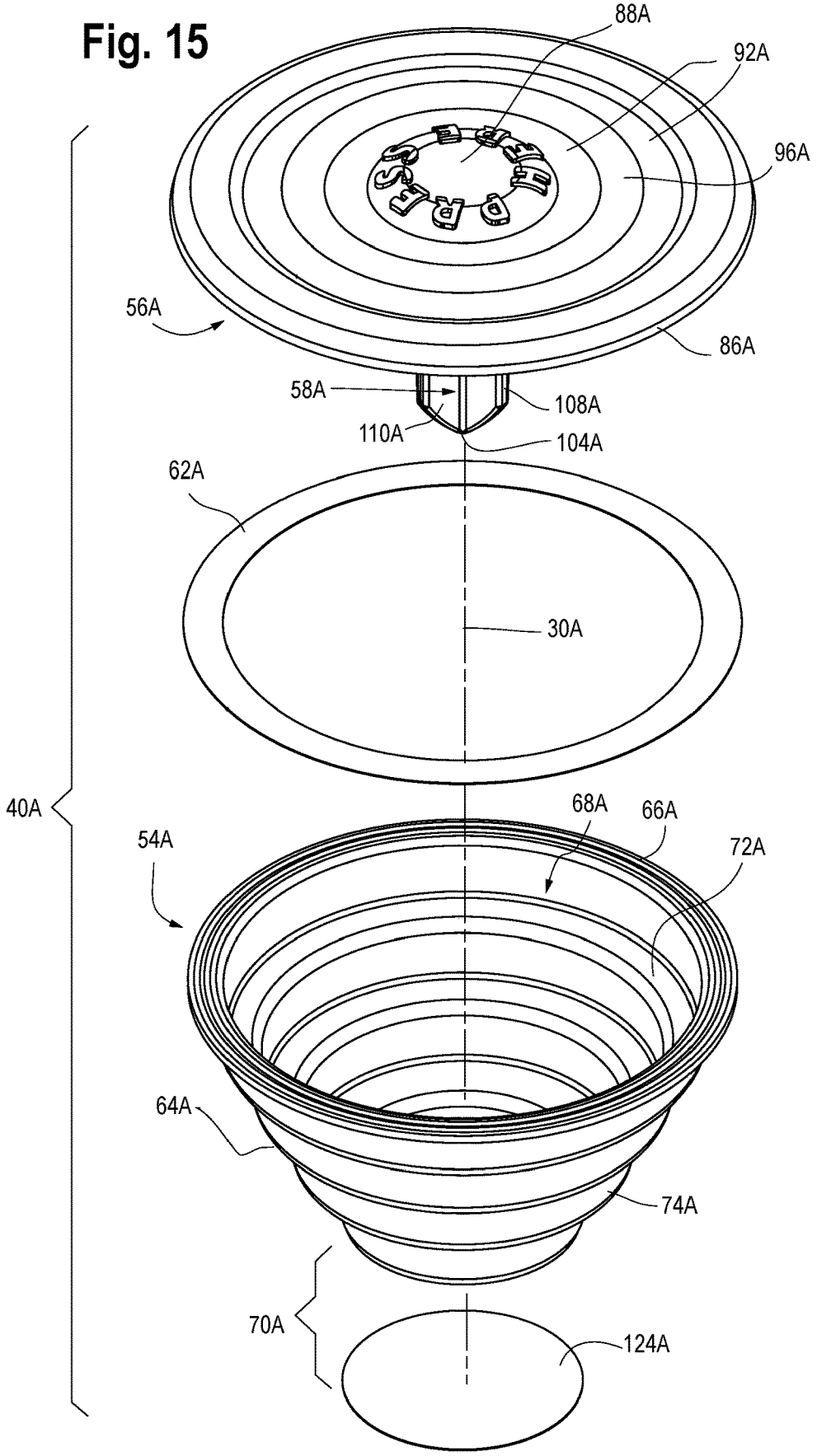
FIG. 15 is an enlarged, exploded, perspective view, taken from above, of a second embodiment of a dispensing system of the present invention.
Figure 16:
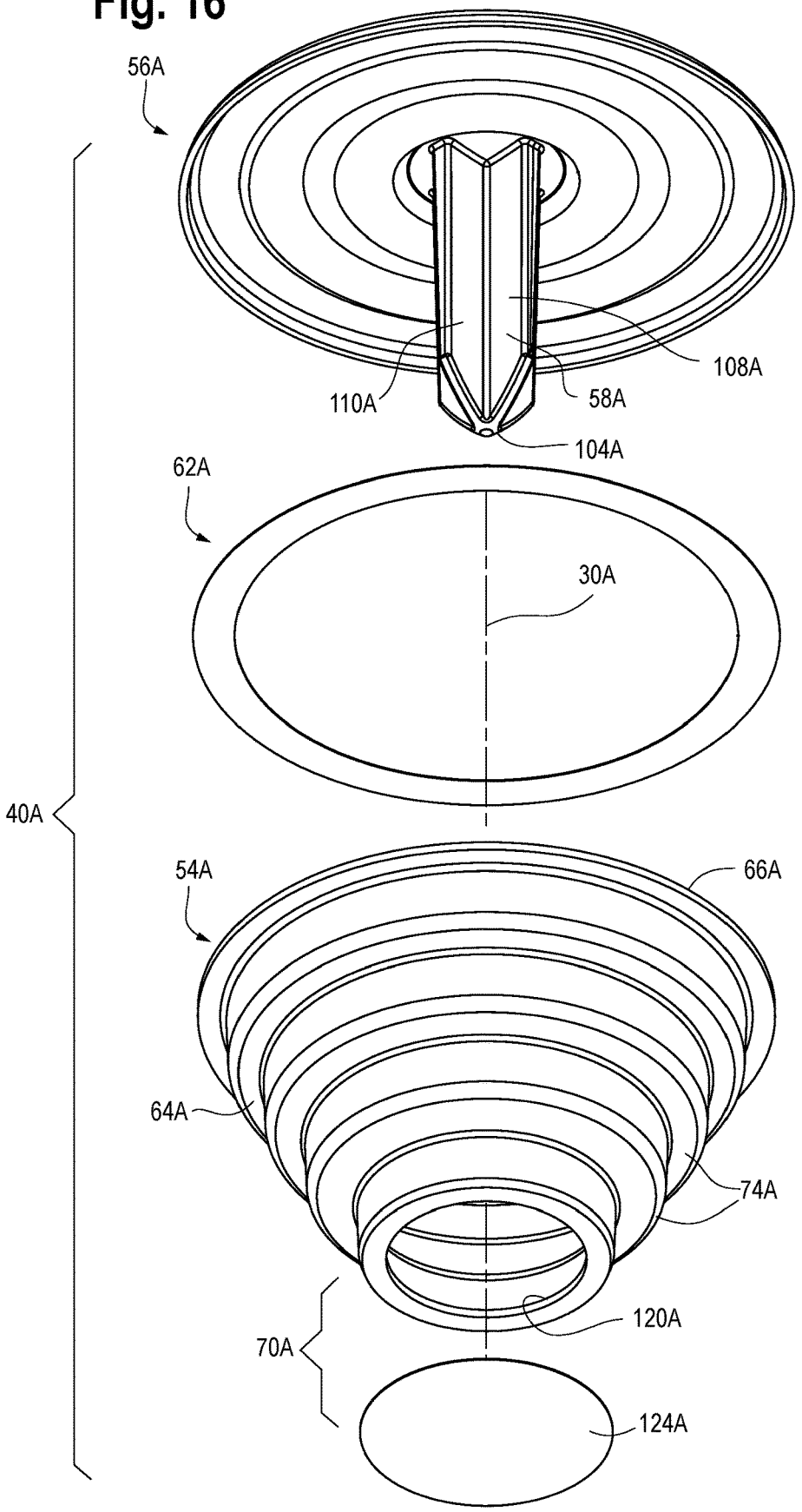
FIG. 16 is an enlarged, exploded, perspective view, taken from below, of the dispensing system shown in FIG. 15.
Figure 17:
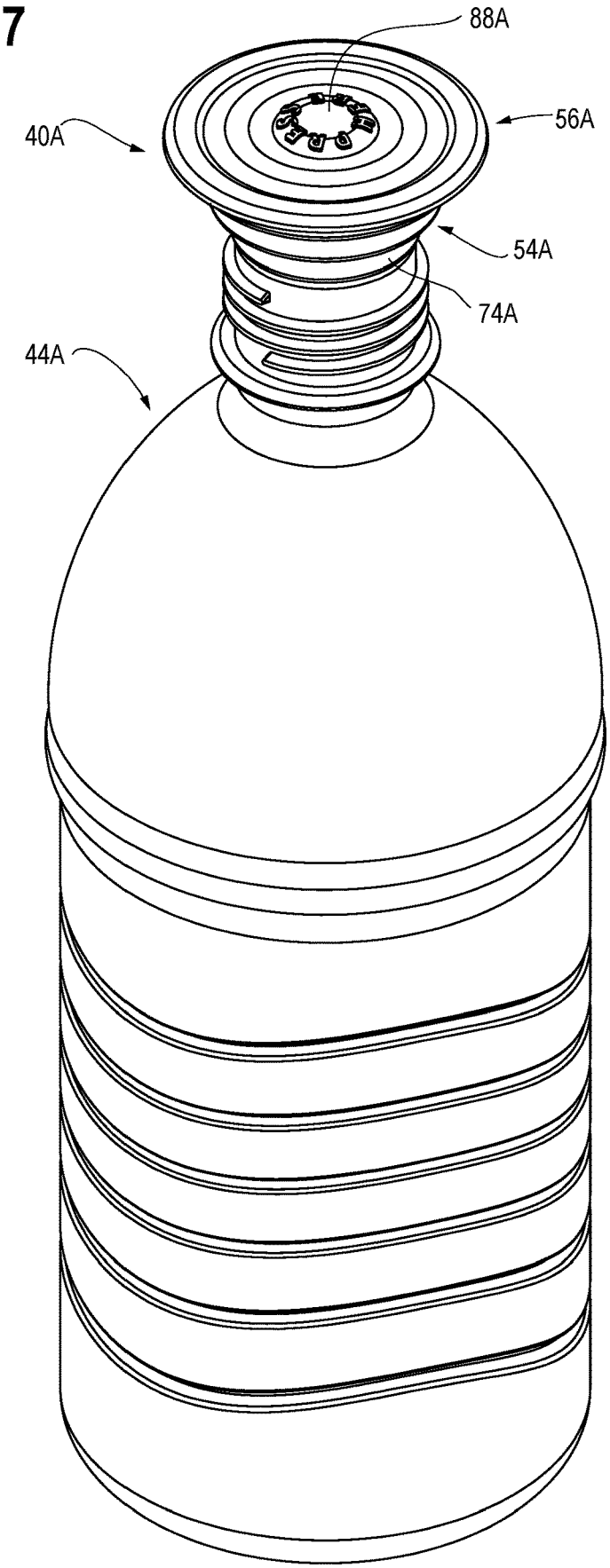
FIG. 17 is a perspective view, taken from above, of the system shown in FIG. 15 assembled and placed at the opening of a container.
Figure 18:
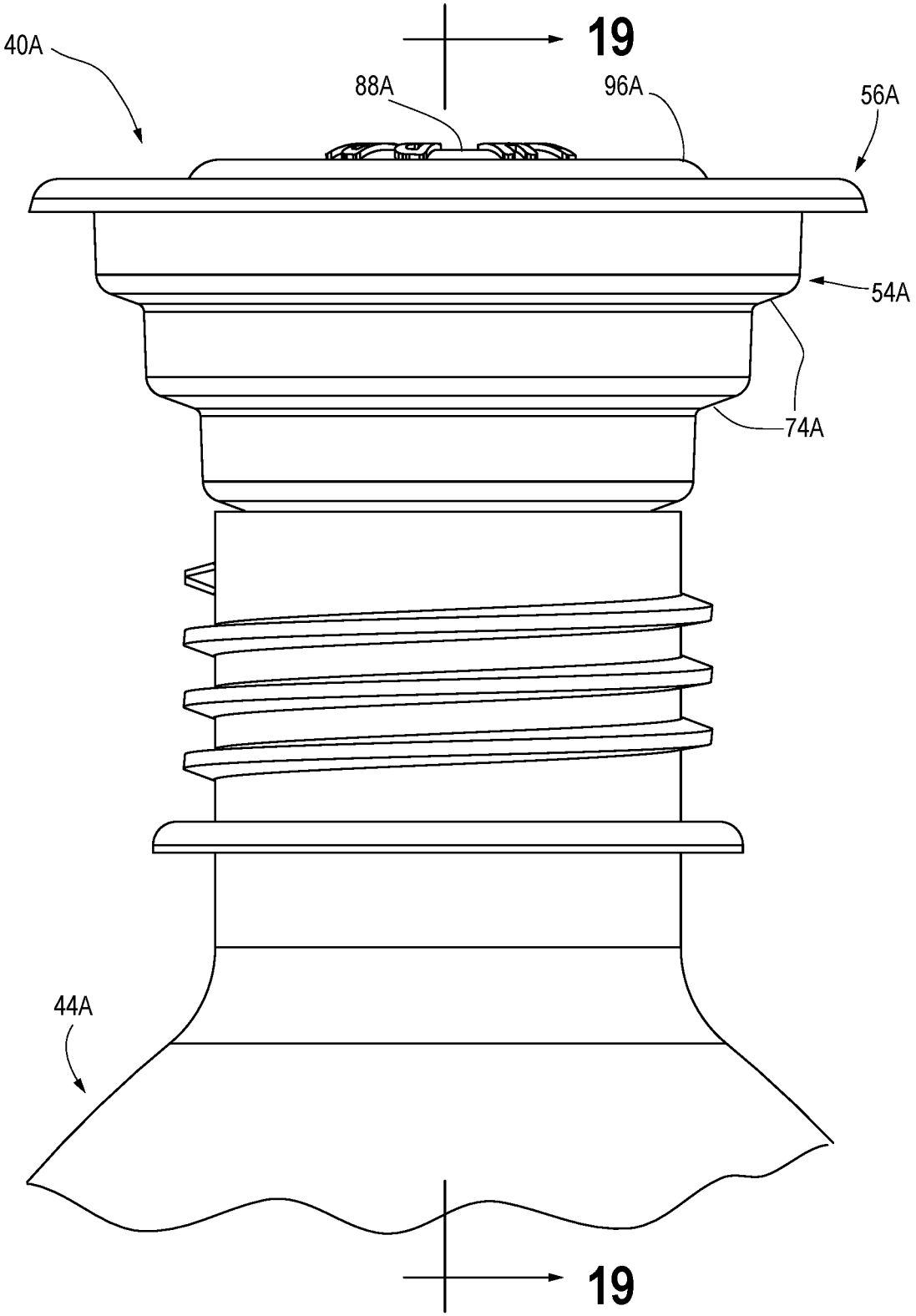
FIG. 18 is an enlarged, fragmentary, side-elevation view of the second embodiment of the system and the upper portion of the container shown in FIG. 17.
Figure 19:
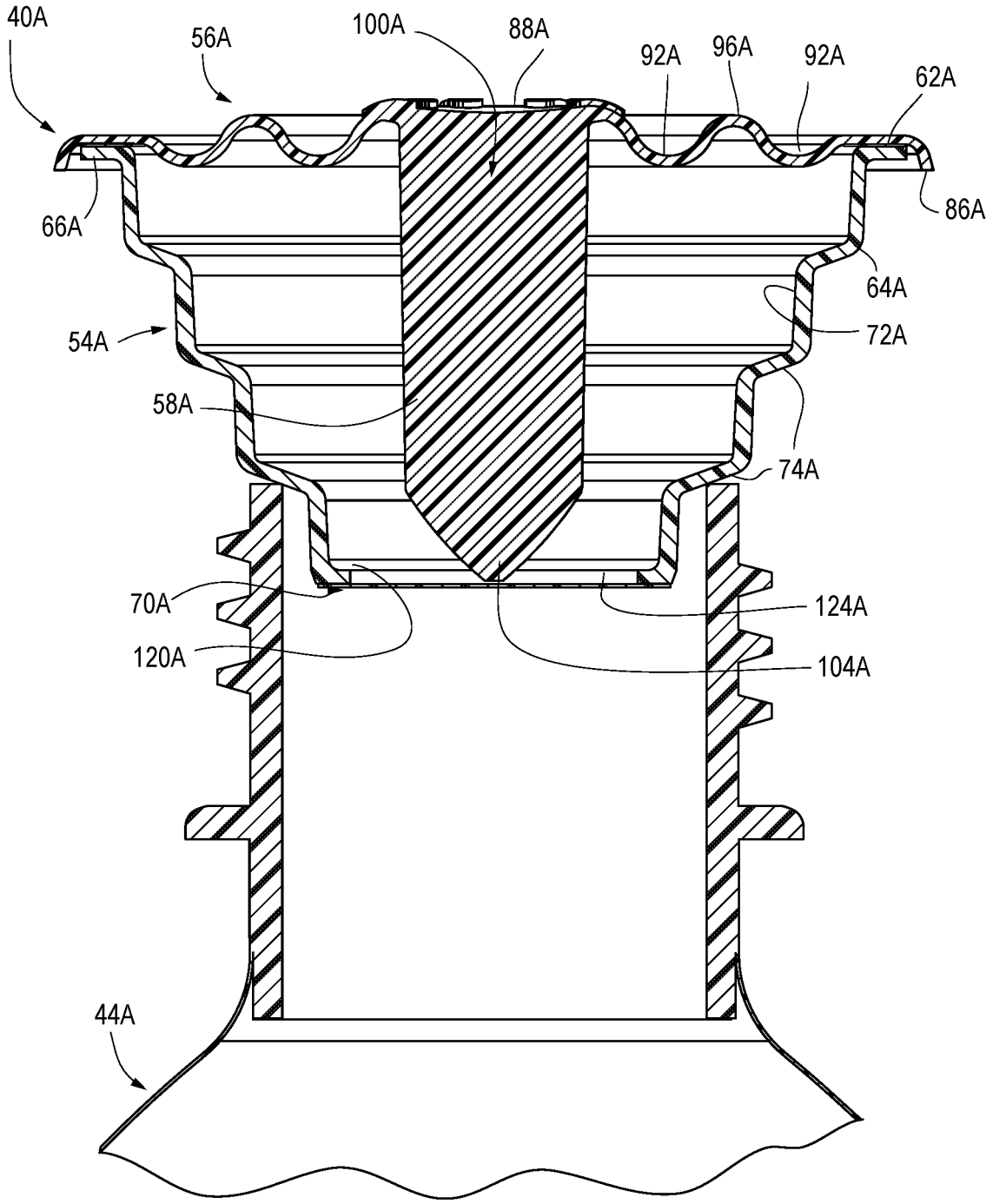
FIG. 19 is an enlarged, fragmentary, cross-sectional view of the second embodiment system and the upper portion of the container, taken generally along plane 19-19 in FIG. 18.

With reference to FIGS. 15 and 16, the second embodiment of the system 40A includes the basic components of a body 54A and a lid 56A. The lid 56A includes an elongate post 58A. A ring-like foil liner 62A is sealed between the body 54A and the lid 56A to attach the lid 56A to the body 54A. The body 54A includes a sealed bottom end 70A that may be breached by movement of the lid 56A and the post 58A to dispense a substance stored within the body 54A. The second illustrated embodiment of the system 40A operates in a similar manner as described in detail above with respect to the first illustrated embodiment of the system 40.

With reference now to FIG. 16, the second embodiment of the system 40A differs from the first embodiment of the system 40 in that the second embodiment of the system 40A includes sealed bottom end 70A that has the form of a molded-open second opening or bottom aperture 120A in the body 54A, which is covered or sealed by a disc-like seal or bottom liner 124A. The bottom liner 124A is preferably formed from the same foil or metallic composite material as the ring-like liner 62A and may be sealed to the body 54A via an induction heating process, heat weld, adhesive, etc. The molded-open aperture 120A permits the body 54A to be advantageously filled with a substance from the bottom. In addition, the use of a secondary liner 124A may greatly reduce the complexity and cost of the manufacturing process utilized for forming or molding the body 54A. In the second embodiment of the system 40A, the post 58A confronts and ruptures the bottom liner 124A to create a dispensing orifice 80A in the ruptured liner 124A.

Figure 20:
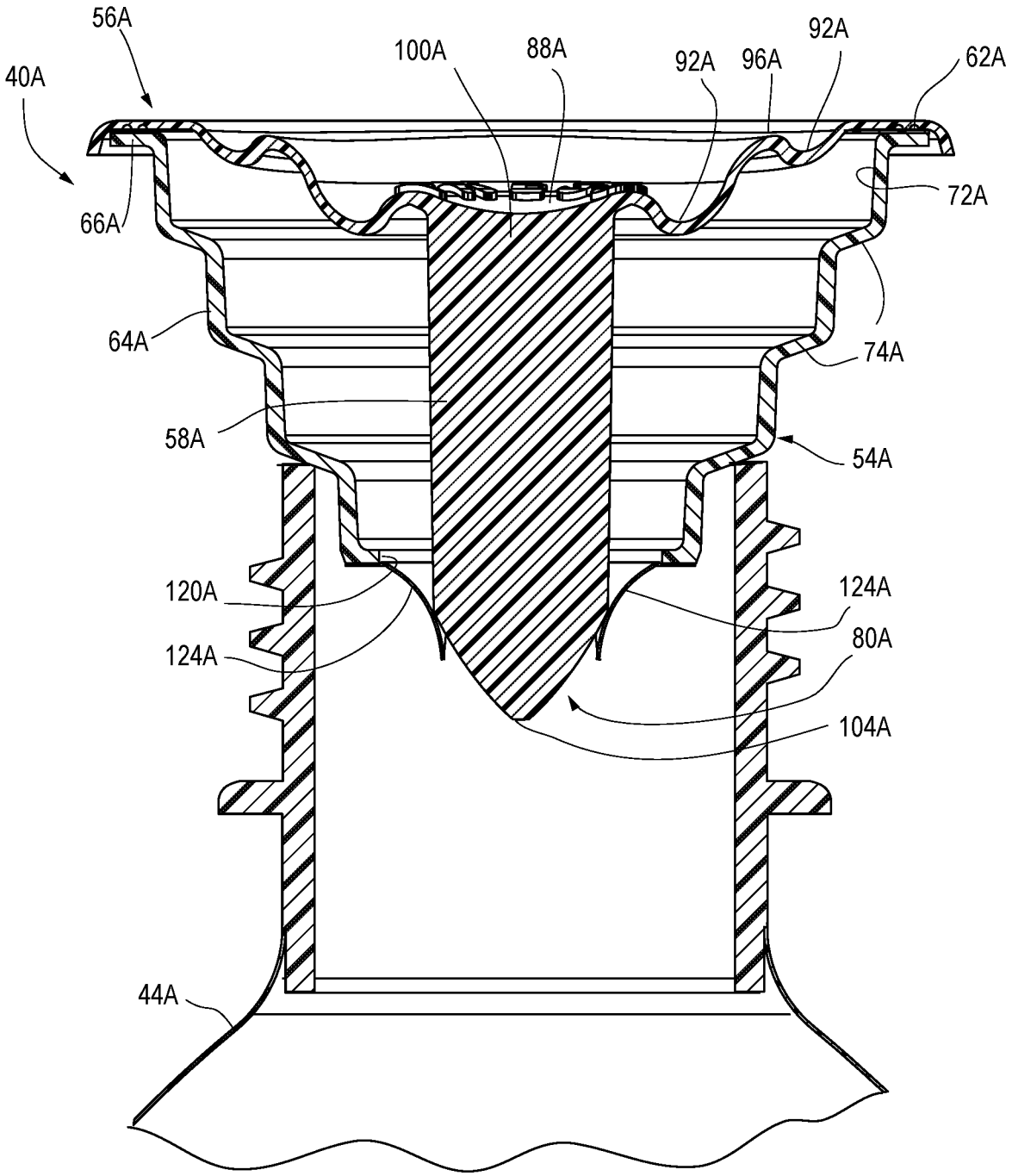
FIG. 20 is an enlarged, fragmentary, cross-sectional view of the second embodiment of the system and the upper portion of the container that is similar to FIG. 19, however

With reference now to FIGS. 16 and 20, the second embodiment of the system 40A further differs from the first embodiment of the system 40 in that the second embodiment of the system 40A includes an exterior surface 74A on the body 54A that has the form of a plurality of annular shoulders that increase in size from the sealed bottom end 70A to the top end 66A of the wall 64A.

The inventors have found that providing the body 54A with an exterior surface 74A that includes a plurality of increasingly larger annular shoulders also accommodates the placement of the sealed bottom end 70A into or onto a large variety of standard and non-standard containers with varying sizes of openings or neck finishes. Furthermore, the user of the dispensing system 40A need not be educated about, or otherwise be made aware of, the variability of container openings or neck finishes on the market.

It will be appreciated that in one alternative embodiment, not illustrated, the dispensing system may be configured with a body, lid, and a post, wherein the body has an open bottom end that may be assembled with a separate package or pod containing an additive or other substance to be dispensed. Such a system would include a lid covering the top end of the body, the lid having a press portion for being engaged by a user of the system, and a post extending from the lid beneath the press portion. The lid would have a first position and a second position moved relative to the first position, wherein in the second position at least a portion of the lid is deflected axially inwardly toward the open bottom end of the body. The pod could be removably attached to the body at the open bottom end thereof but retained with a sufficient force to hold the pod during the actuation process as next discussed. The pod would have a hollow body defining a volume for storing a substance. The pod hollow body would have a sealed top end and a sealed bottom end. The post would be configured such that movement from the unactuated, first position of the lid into said actuated, second position of the lid causes the post to breach the pod sealed top end and then the pod sealed bottom end to create a pod dispensing orifice in the pod sealed bottom end to accommodate movement of a substance out of the pod.

It will be understood that such an arrangement of the system for use with a pod would advantageously allow the system to be re-used with multiple pods.

Various modifications and alterations to this invention will become apparent to those skilled in the art without departing from the scope and spirit of this invention. Illustrative embodiments and examples of the system are provided as examples only and are not intended to limit the scope of the present invention.

What is claimed is:

1. A dispensing system for use in dispensing a substance that may be stored within said system, said system comprising:

a body having an outer wall with an exterior surface and having an interior surface defining a volume for storing a substance, said outer wall having an open top end and a sealed bottom end;

a flexible lid that is connected to said body to cover said open top end, said lid having a press portion for being engaged by a user of said system, said lid having a first position and a second position moved relative to said first position, wherein in said second position at least a portion of said lid is deflected toward said sealed bottom end of said body; and a post connected to said lid, said post configured in said second position of said lid to breach said sealed bottom end of said body to form a dispensing orifice to accommodate movement of a substance out of said body and wherein said exterior surface of said outer wall, defines at least one annular shoulder to accommodate supporting said body on a container having, a predetermined opening size; and wherein said exterior surface of said outer wall defines a plurality of annular shoulders that increase in size from said sealed bottom end to said top end of said outer wall.

2. The dispensing system of claim 1 wherein said post is formed unitarily with said lid.

3. The dispensing system of claim 1 further comprising a liner sealed between said lid and said body to sealingly connect said lid to said body.

4. The dispensing system of claim 1 wherein said exterior surface of said outer wall defines a convex curve to accommodate supporting said body on a container having a predetermined opening size.

5. The dispensing system of claim 1 wherein said sealed bottom end of said body includes a frangible portion of said body that is breached by movement of said post with said lid in said second position to create said dispensing orifice.

6. The dispensing system of claim 5 wherein said frangible portion of said body includes a pair of intersecting lines of reduced thickness material of said body and four movable petals defined between said intersecting lines.

7. A dispensing system for use in dispensing a substance that may be stored within said system, said system comprising:

a body having an outer wall with an exterior surface and having an, interior surface defining a volume for storing a substance, said outer wall having an open top end and, a sealed bottom end;

a flexible lid that is connected to said body to cover said open too end, said lid having a press portion for being engaged by a user of said system, said lid having a first position and a second position moved relative to said first position, wherein in said second position at least a portion of said lid is deflected toward said sealed bottom end of said body; and a post connected to said lid, said post configured in said second position of said lid to breach said sealed bottom end of said body to form a dispensing orifice to accommodate movement of a substance out of said body; wherein said sealed bottom end of said body includes a bottom aperture in said body and a bottom liner that is sealed over said bottom aperture.

8. The dispensing system of claim 1 wherein said lid is biased to said first position.

9. The dispensing system of claim 1 wherein said lid includes at least one raised annular portion and at least one recessed annular portion each surrounding said press portion.

10. The dispensing system of claim 1 said in combination with a fluent substance, said system and said fluent substance together defining a package.

11. The dispensing system of claim 1 wherein said post has the form of a pair of elongate, intersecting walls that terminate in a pointed distal end.

12. The dispensing system of claim 1 wherein said post is bi-injection molded with said lid.

13. The dispensing system of claim 1 wherein said body is generally cone-shaped with said upper end being larger than said sealed bottom end.

14. A dispensing system for use in dispensing a substance that may be stored within said system, said system comprising:

a body having an outer wall with an exterior surface and having an interior surface defining a volume for storing a substance, said outer wall having an open top end and a sealed bottom end, a flexible lid that is connected to said body to cover said open top end, said lid having a press portion for being engaged by a user of said system, said lid having a first position and a second position moved relative to said first position, wherein in said second position at least a portion of said lid is deflected toward said sealed bottom end of said body;

a post connected to said lid, said post configured in said second position of said lid to breach said sealed bottom end of said body to form a dispensing orifice to accommodate movement of a substance out of said body; and wherein said exterior surface of said outer wall defines a plurality of annular shoulders that increase in size from said sealed bottom end to said top end of said outer wall with said lid in said first position.

* * * * *